US009839884B2

(12) United States Patent
Regalbuto et al.

(10) Patent No.: US 9,839,884 B2
(45) Date of Patent: Dec. 12, 2017

(54) METHOD AND APPARATUS FOR IMPROVED MIXING OF SOLID, LIQUID, OR GASEOUS MATERIALS AND COMBINATIONS THEREOF

(71) Applicants: John R. Regalbuto, Columbia, SC (US); John Anthony Regalbuto, Georgetown, MA (US)

(72) Inventors: John R. Regalbuto, Columbia, SC (US); John Anthony Regalbuto, Georgetown, MA (US)

(73) Assignee: University of South Carolina, Columbia, SC (US)

( * ) Notice: Subject to any disclaimer, the term of this patent is extended or adjusted under 35 U.S.C. 154(b) by 0 days.

(21) Appl. No.: 14/029,299

(22) Filed: Sep. 17, 2013

(65) Prior Publication Data

US 2014/0078858 A1 Mar. 20, 2014

Related U.S. Application Data

(60) Provisional application No. 61/702,465, filed on Sep. 18, 2012, provisional application No. 61/763,038, filed on Feb. 11, 2013.

(51) Int. Cl.
*B01F 7/00* (2006.01)
*B01F 7/16* (2006.01)
(Continued)

(52) U.S. Cl.
CPC ..... *B01F 7/00191* (2013.01); *B01F 7/166* (2013.01); *B01F 7/22* (2013.01); *B01F 15/00506* (2013.01)

(58) Field of Classification Search
CPC .... B01F 7/00191; B01F 7/166; B01F 7/0025; B01F 7/18; B01F 7/16
(Continued)

(56) References Cited

U.S. PATENT DOCUMENTS 1,770,459 A * 7/1930 Child ..... A23G 3/0215 366/296
1,987,700 A * 1/1935 Muir ..... A47J 43/105 366/129
(Continued)

FOREIGN PATENT DOCUMENTS

CZ 1376 4/1994

OTHER PUBLICATIONS

Strejc et al., "Micháni kapalin protiběžnými míchadly" Chemický průmysl roč. 45/70 (1995) číslo 2, pp. 52-57.

*Primary Examiner* — Tony G Soohoo
*Assistant Examiner* — Elizabeth Insler
(74) *Attorney, Agent, or Firm* — Dority & Manning, PA

(57) ABSTRACT

Mixer apparatus configured to mix the contents of a vessel without the formation of a vortex are provided. The mixer apparatus can include a rotational mechanism; a gearbox attached to the rotational mechanism; a first shaft attached to the gearbox; a second shaft attached to the gearbox; a first rotor configured to be rotated by the first shaft; and a second rotor configured to be rotated by the second shaft. The first shaft can be coaxial with the second shaft, and the gearbox can be configured to rotate the first shaft and the second shaft in opposite directions. The first rotor and the second rotor are configured to be rotated in opposite directions.

23 Claims, 19 Drawing Sheets

(51) Int. Cl.
*B01F 7/22* (2006.01)
*B01F 15/00* (2006.01)

(58) Field of Classification Search
USPC ..... 366/252, 287, 330.1, 293, 294, 295, 296
See application file for complete search history.

(56) References Cited

U.S. PATENT DOCUMENTS

| | | | | |
|---|---|---|---|---|
| 2,209,287 | A * | 7/1940 | Simpson | B01F 13/002 310/83 |
| 2,994,594 | A | 8/1961 | Haines | |
| 3,734,469 | A * | 5/1973 | Goldstein | B01F 7/0025 165/109.1 |
| 4,506,989 | A | 3/1985 | Reh | |
| 6,050,720 | A * | 4/2000 | Tuyuki | B01F 7/00641 366/264 |
| 6,543,726 | B2 | 4/2003 | Illingworth | |
| 7,422,363 | B2 * | 9/2008 | Parker | B01F 7/00266 366/129 |

* cited by examiner

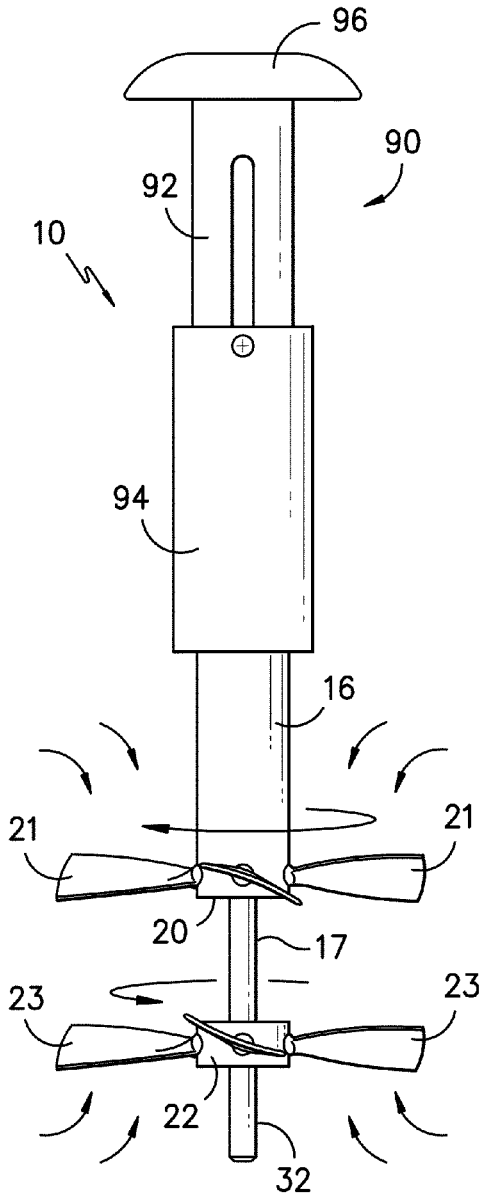
FIG. –9A–
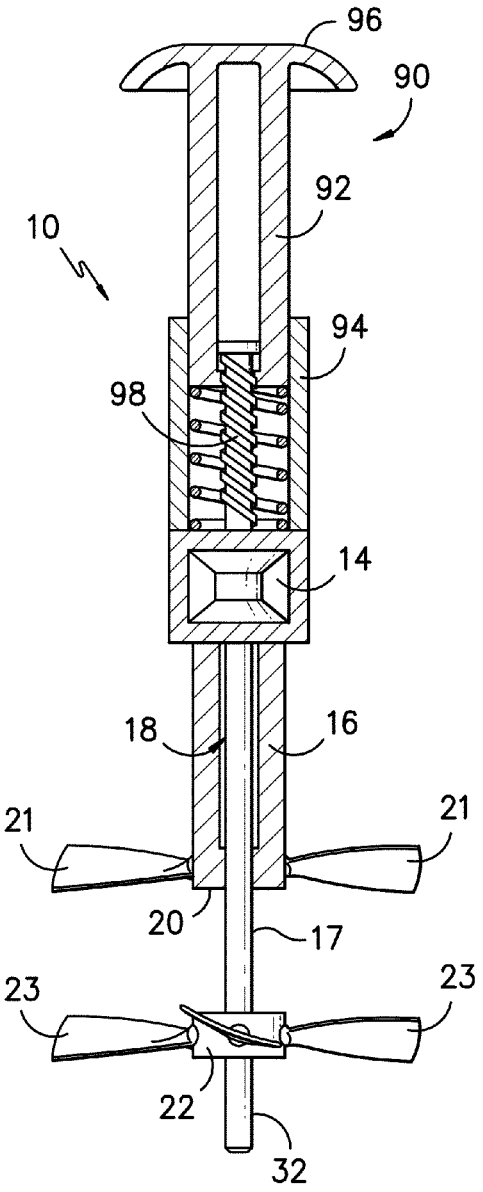
FIG. –9B–

METHOD AND APPARATUS FOR IMPROVED MIXING OF SOLID, LIQUID, OR GASEOUS MATERIALS AND COMBINATIONS THEREOF

PRIORITY INFORMATION

The present application claims priority to U.S. Provisional Patent Application Ser. No. 61/702,465 of Regalbuto, et al. titled "Method and Apparatus for Improved Mixing of Solid, Liquid, or Gaseous Materials and Combinations Thereof" filed on Sep. 18, 2012, and to U.S. Provisional Patent Application Ser. No. 61/763,038 of Regalbuto, et al. titled "Method and Apparatus for Improved Mixing of Solid, Liquid, or Gaseous Materials and Combinations Thereof" filed on Feb. 11, 2013; the disclosures of which are incorporated herein by reference.

BACKGROUND

When a reactor or mixing vessel uses a single impeller to agitate the fluid contents, a vortex is generally created. This vortex is inimical to proper mixing. In order to disrupt the formation of such a vortex, baffles have been included on the inside of the reactor/mixing vessel to prevent the formation of a vortex by disrupting the flow of the contents. Alternatively, scrapers could be associated with the mixing apparatus and inserted into the reactor/mixing vessel to prevent the formation of a vortex by disrupting the flow of the contents. Such scrapers can be stationary and/or rotating.

After prolonged use, however, deposits of materials can collect unevenly on the baffles. These deposits should be removed for consistent performance, leading to downtime and subsequent loss of production output and higher production costs.

Additionally, the use of baffles and/or scrapers requires higher torque from the mixing motor. Higher torque requires, in turn, larger and more expensive motors, resulting in higher capital costs as well as higher operating costs. This higher torque can also create enough force to cause the vessel to begin to rotate if not held in place, creating additional work and/or a dangerous environment. Similarly, the impellers can push up into a cowling (when present) that creates a suction force against the user, which can be particularly difficult to handle on a hand-held mixer.

As such, a need exists for a method and apparatus that allows for proper mixing of fluids without baffles, while still eliminating vortex formation in the reaction/mixing vessel and minimizing torque and power consumption.

SUMMARY

Objects and advantages of the invention will be set forth in part in the following description, or may be obvious from the description, or may be learned through practice of the invention.

Mixer apparatus is generally provided that is configured to mix the contents of a vessel without the formation of a vortex. Methods are also generally provided for mixing a fluid within a mixing vessel using any of the presently described mixer apparatus, particularly without a baffle or scrapper.

In one embodiment, the mixer apparatus includes a rotational mechanism; a gearbox attached to the rotational mechanism; a first shaft attached to the gearbox; a second shaft attached to the gearbox; a first rotor configured to be rotated by the first shaft; and a second rotor configured to be rotated by the second shaft. The first shaft can be coaxial with the second shaft, and the gearbox can be configured to rotate the first shaft and the second shaft in opposite directions. In one particular embodiment, the first rotor and the second rotor are configured to be rotated in opposite directions.

In another embodiment, the mixer apparatus includes a rotational mechanism; a first gearbox attached to the rotational mechanism; a second gearbox attached to the rotational mechanism; a first shaft attached to the first gearbox; a second shaft attached to the second gearbox; a first rotor configured to rotated by the first shaft; and a second rotor configured to be rotated by the second shaft. The first shaft can be coaxial with the second shaft, and the first rotor and the second rotor can be configured to be rotated in opposite directions.

In yet another embodiment, the mixer apparatus includes a rotational mechanism; a gearbox attached to the rotational mechanism; a shaft attached to the gearbox; a first rotor configured to rotated by the shaft; and a second rotor configured to be rotated by the shaft, wherein the first rotor and the second rotor are configured to be rotated in the same direction.

Other features and aspects of the present invention are discussed in greater detail below.

BRIEF DESCRIPTION OF THE DRAWINGS

A full and enabling disclosure of the present invention, including the best mode thereof to one skilled in the art, is set forth more particularly in the remainder of the specification, which includes reference to the accompanying figures, in which:

FIGS. 9A and 9B show alternative embodiments that include a hand-powered mixer, instead of a motor-powered mixer, as the rotational mechanism;

Figure 1:
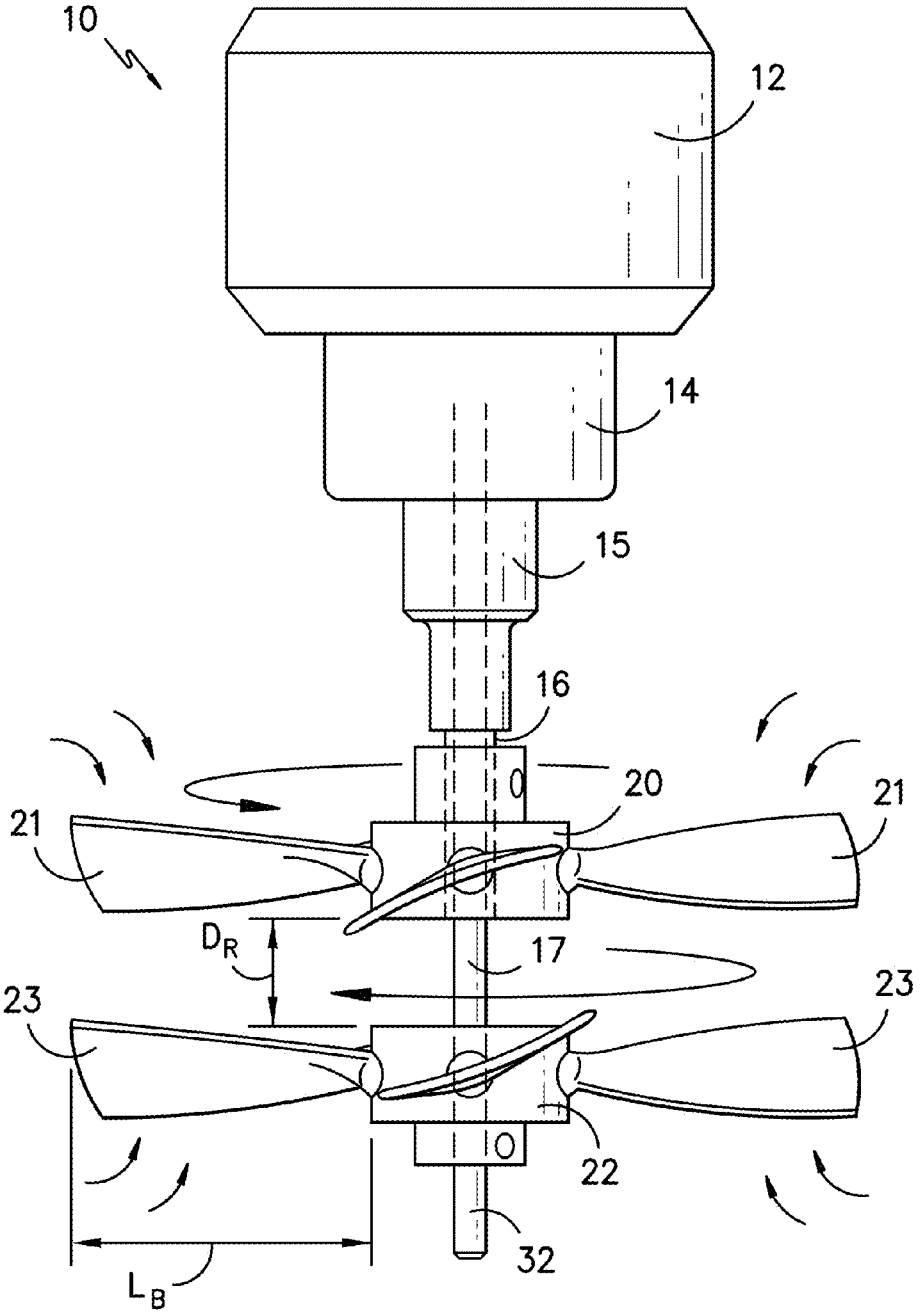
FIG. 1 shows an exemplary mixer apparatus utilizing contra-rotating rotors.

Repeat use of reference characters in the present specification and drawings is intended to represent the same or analogous features or elements of the present invention.

DETAILED DESCRIPTION

Reference now will be made to the embodiments of the invention, one or more examples of which are set forth below. Each example is provided by way of an explanation of the invention, not as a limitation of the invention. In fact, it will be apparent to those skilled in the art that various modifications and variations can be made in the invention without departing from the scope or spirit of the invention. For instance, features illustrated or described as one embodiment can be used on another embodiment to yield still a further embodiment. Thus, it is intended that the present invention cover such modifications and variations as come within the scope of the appended claims and their equivalents. It is to be understood by one of ordinary skill in the art that the present discussion is a description of exemplary embodiments only, and is not intended as limiting the broader aspects of the present invention, which broader aspects are embodied exemplary constructions.

Apparatus and methods are generally provided for mixing the contents of a reaction/mixing vessel utilizing multiple rotors turned by a rotational mechanism (e.g., a motor, a push-operated lever, etc.). Various configurations are provided that utilize using opposing toroidal flow or matching toroidal flow, which can be created by contra-rotating rotors or dual rotors in conjunction with suitable rotor blades. FIGS. 8A-8H show diagrams of various configurations that are particularly suitable for mixing the contents of a reaction/mixing vessel.

Figure 8A:
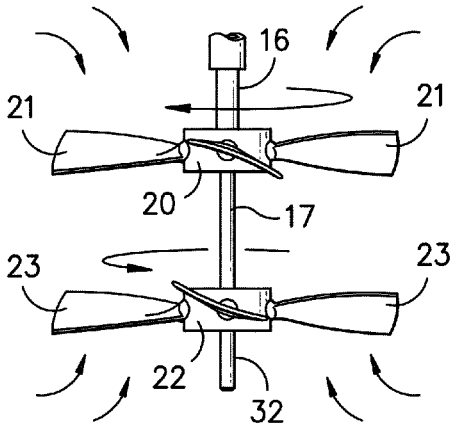
FIGS. 8A-8H show diagrams of various configurations that are particularly suitable for mixing the contents of a reaction/mixing vessel.
Figure 8B:
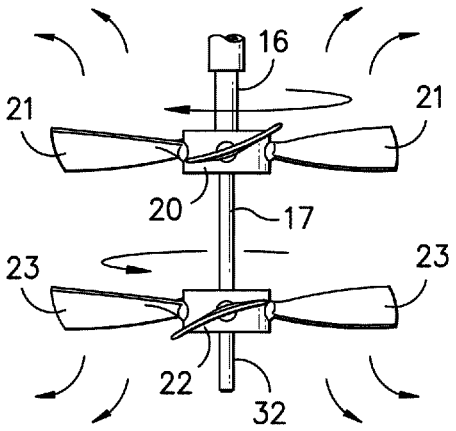

FIG. 8A shows an embodiment with opposing toroidal flow directed inward created by contra-rotating rotors. Conversely, FIG. 8B shows an embodiment with opposing toroidal flow directed outward created by contra-rotating rotors.

Figure 8C:
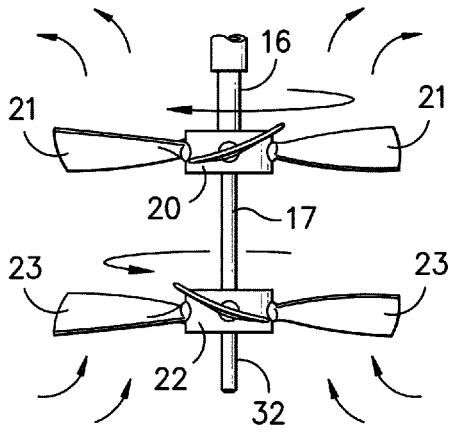
Figure 8D:
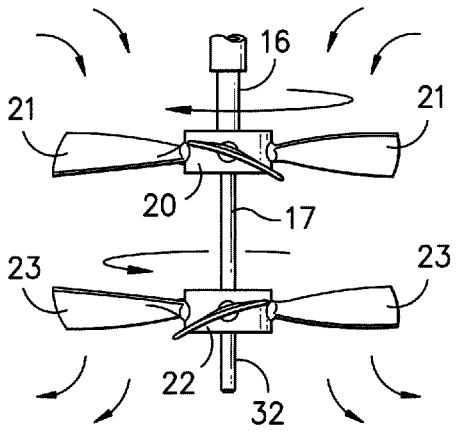

FIG. 8C shows an embodiment with matching toroidal flow directed upward created by contra-rotating rotors. On the other hand, FIG. 8D shows an embodiment with matching toroidal flow directed downward created by contra-rotating rotors.

Figure 8E:
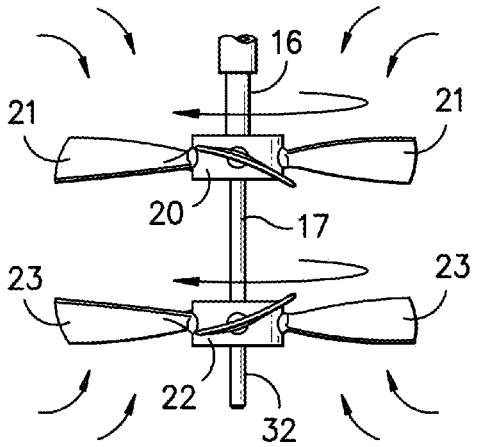
Figure 8F:
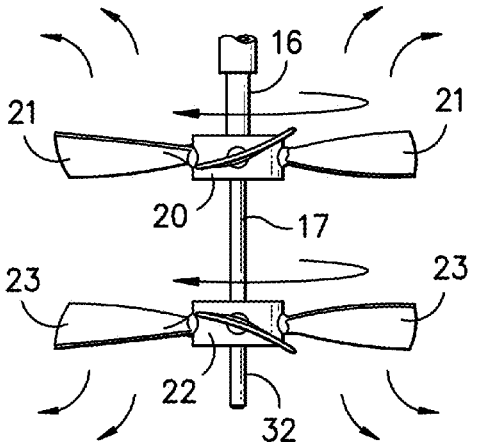

FIG. 8E shows an embodiment with opposing toroidal flow directed inward created by dual-rotating rotors. To the contrary, FIG. 8F shows an embodiment with opposing toroidal flow directed outward created by dual-rotating rotors.

Figure 8G:
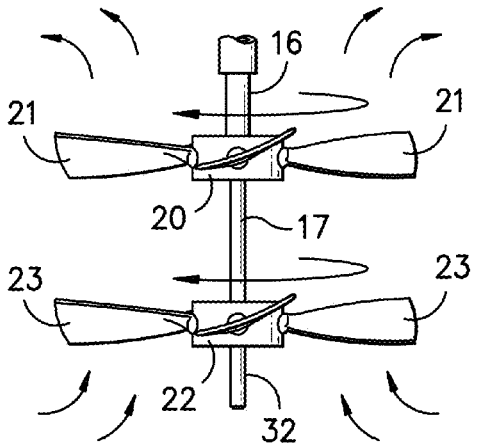
Figure 8H:
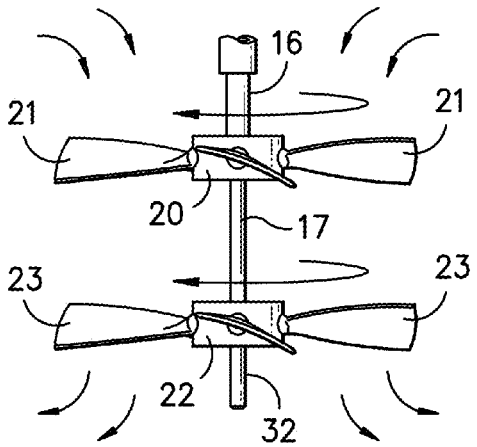

FIG. 8G shows an embodiment with matching toroidal flow directed upward created by dual-rotating rotors. Conversely, FIG. 8H shows an embodiment with matching toroidal flow directed downward created by dual-rotating rotors.

In the embodiments shown in FIGS. 8A-8H and the above descriptions, the direction of rotation of both rotors in each embodiment, along with the angle of the respective blades, can be reversed. That is, referring to FIG. 8A as an example (viewed from the top), though the upper rotor is shown moving clock-wise while the lower rotor is shown moving counter clock-wise to achieve the opposing toroidal flow directed inward, it is understood that the opposing toroidal flow directed inward can be achieved by the upper rotor moving counter clock-wise while the lower rotor moves clock-wise and appropriately angling the respective rotor blades. Such an opposite rotational direction can be applied to each of the shown embodiments in FIGS. 8A-8H.

Each of these configurations is discussed in greater detail in the following descriptions.

I. Opposing Toroidal Flow, Contra-Rotating Rotors

In one embodiment, apparatus and methods are generally provided for mixing the contents of a reaction/mixing vessel using opposing toroidal flow created by contra-rotating rotors. The mixing apparatus generally includes two coaxial shafts, one within another (e.g., an inner shaft and an outer shaft), rotating in opposite directions. Rotors with angled rotor blades are attached to each shaft in axial proximity to each other such that the axis of rotation of the two shafts is substantially aligned with the vertical axis of the reaction/mixing vessel (e.g., a cylindrical vessel).

Figure 2:
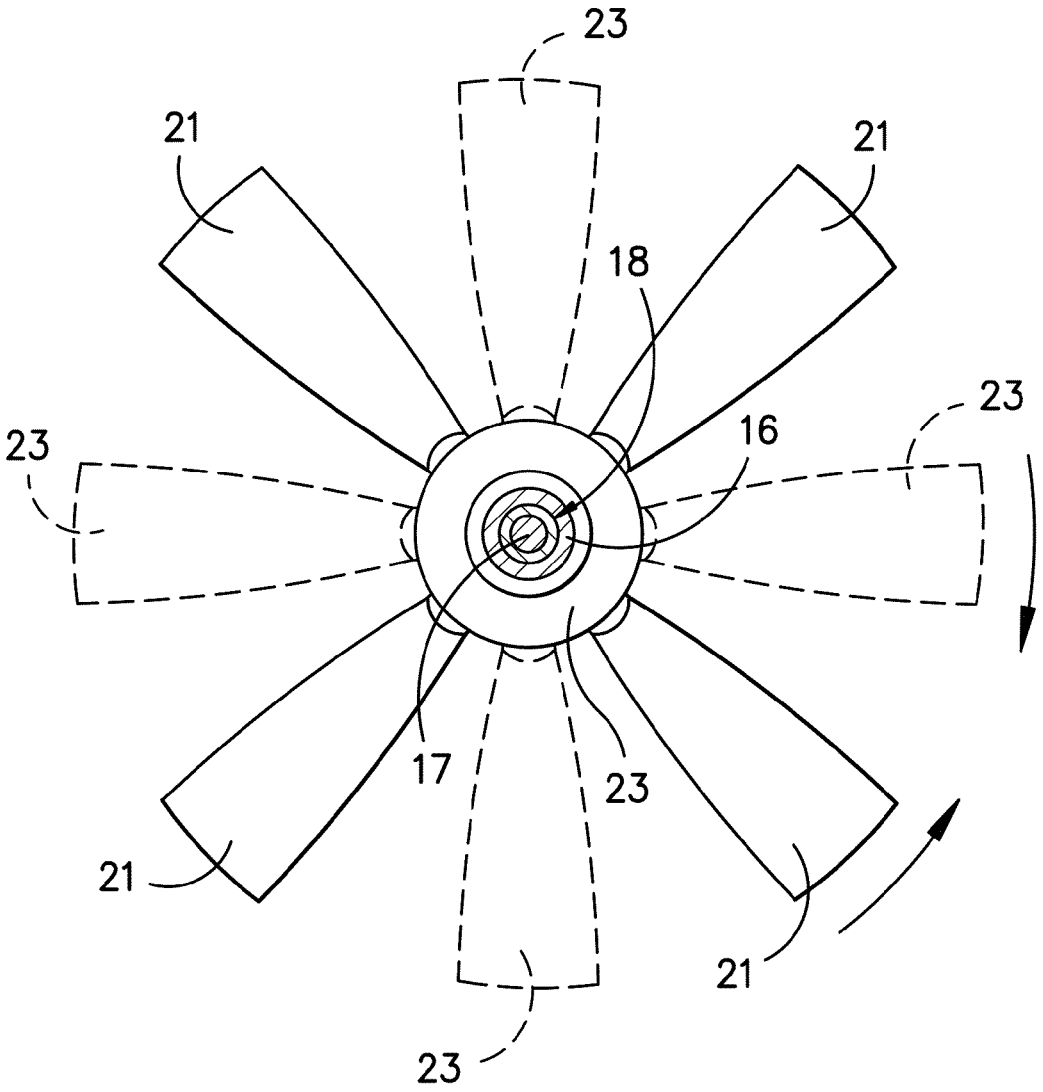
FIG. 2 shows a top view looking below the gearboxes of the exemplary mixer apparatus of FIG. 1.

FIGS. 1 and 2 show one particular embodiment of a mixer apparatus 10. The mixer apparatus 10 generally includes a motor 12 (as the rotational mechanism) and a pair of gearboxes 14, 15. The gearboxes 14, 15 are coupled to a pair of coaxial shafts 16, 17. As shown, the outer shaft 16 defines a hollow center 18 where the inner shaft 17 is located. Thus, the inner shaft 17 is independently rotatable within the hollow center 18 of the outer shaft 16. A lubricant (e.g., grease) can be included within the hollow center 18 of the outer shaft 16 to ensure minimal friction between the coaxial shafts 16, 17 during operation. As such, the inner shaft 17 can rotate opposite to the outer shaft 16 (i.e., one shaft rotates clockwise and the other shaft rotates counter-clockwise).

Figure 3:
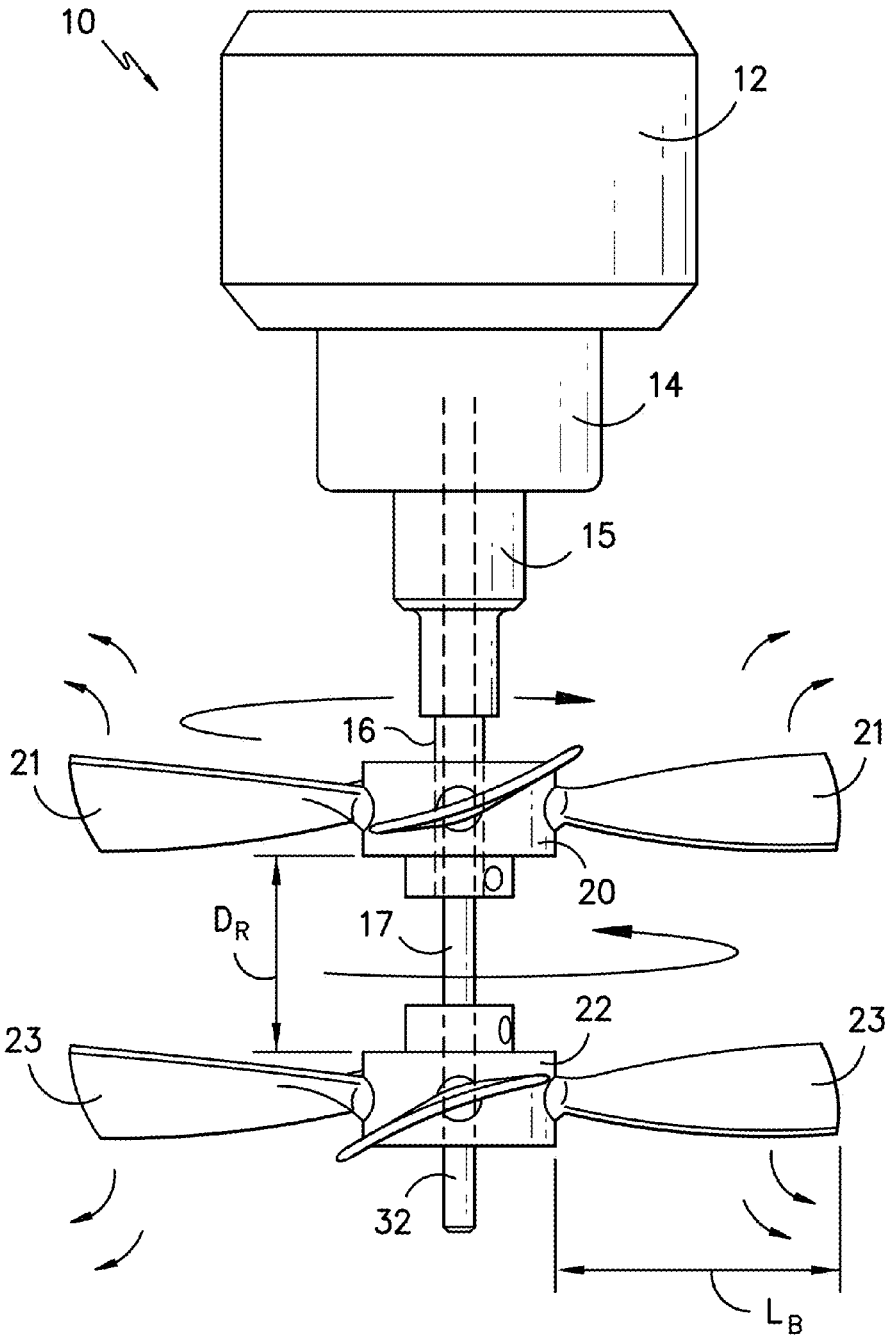
FIG. 3 shows another exemplary mixer apparatus utilizing contra-rotating rotors.
Figure 4:
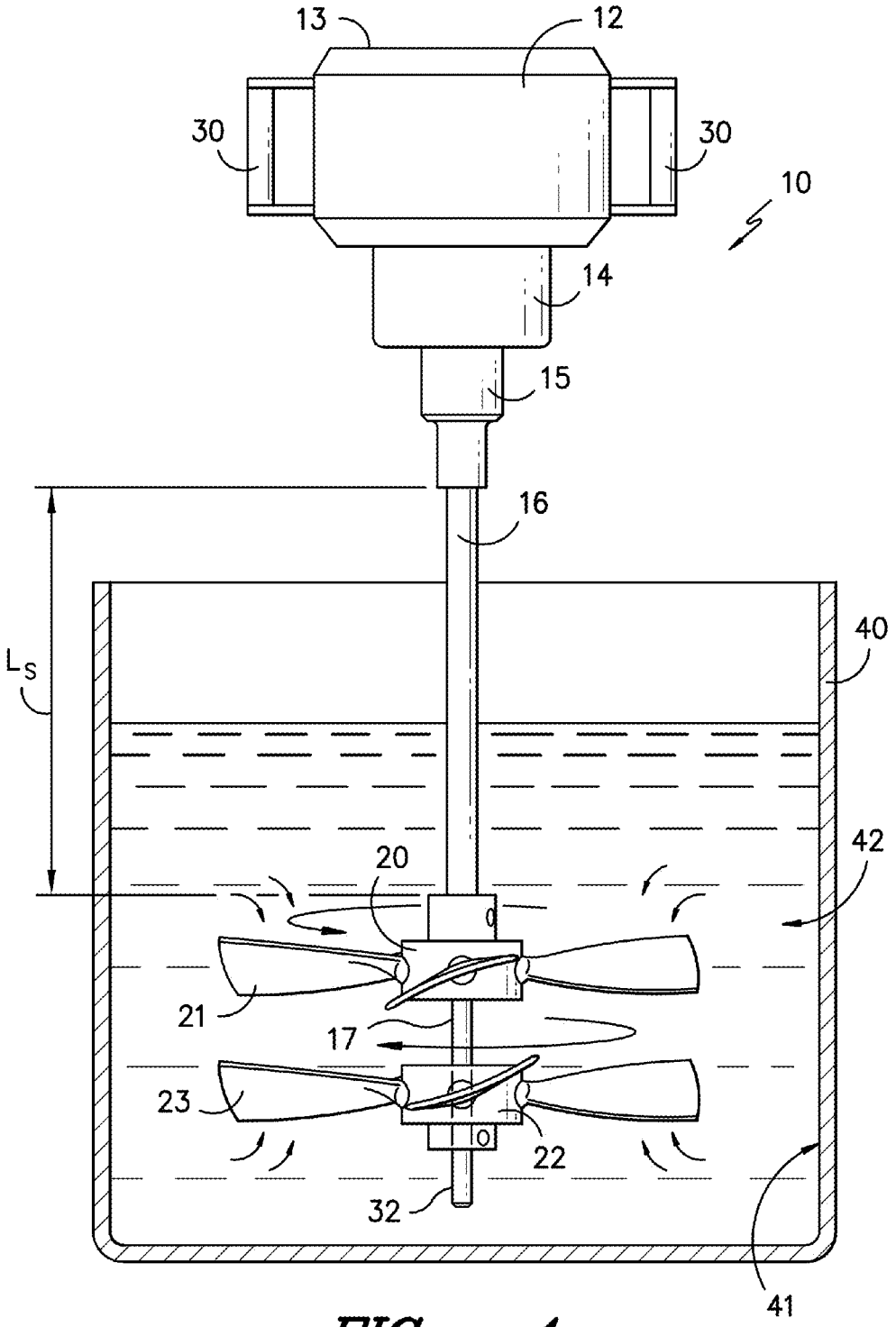
FIG. 4 shows another exemplary mixer apparatus, similar to that shown in FIG. 1, within a mixing vessel.
Figure 5:
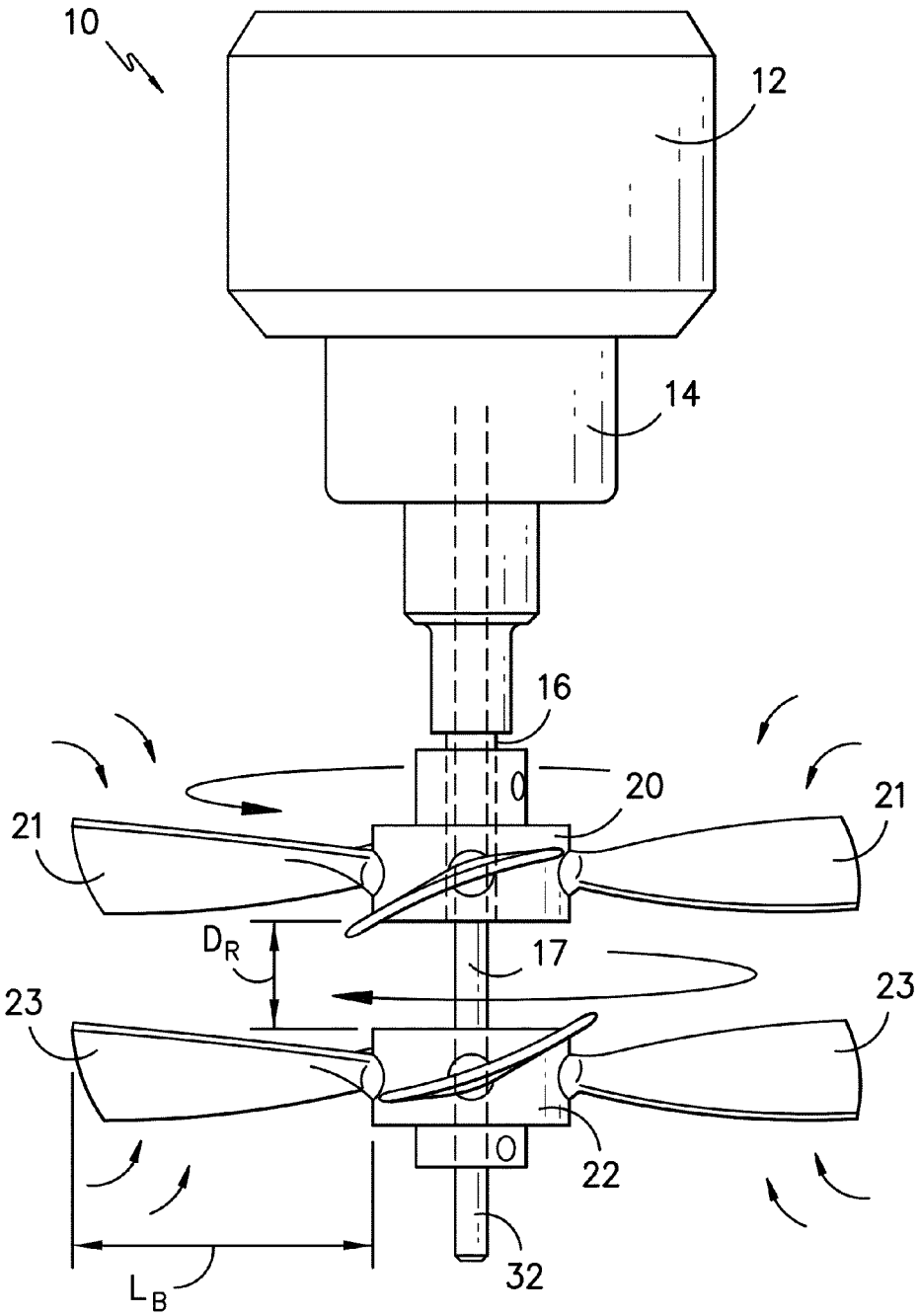
FIG. 5 shows an exemplary mixer apparatus having a single gearbox configured to rotate both rotors in opposite directions.

Although shown having two gearboxes 14, 15 in the embodiments of FIGS. 1 and 3-4, a single gearbox can be utilized to rotate the inner shaft 17 and the outer shaft 16 in opposite directions. For example, FIG. 5 shows a single gearbox 14 that is configured to rotate both the inner shaft 17 and the outer shaft 16 in opposite directions. Thus, the second gearbox shown in FIGS. 1 and 3-4 is optional, depending on the design of the motor and/or gearbox 14.

In such an embodiment, the use of a single gearbox generally rotates the inner shaft 17 and the outer shaft 16 in opposite directions at a fixed speed ratio. In one particular embodiment, the use of a single gearbox generally rotates the inner shaft 17 and the outer shaft 16 in opposite directions at substantially the same speed.

Figure 6:
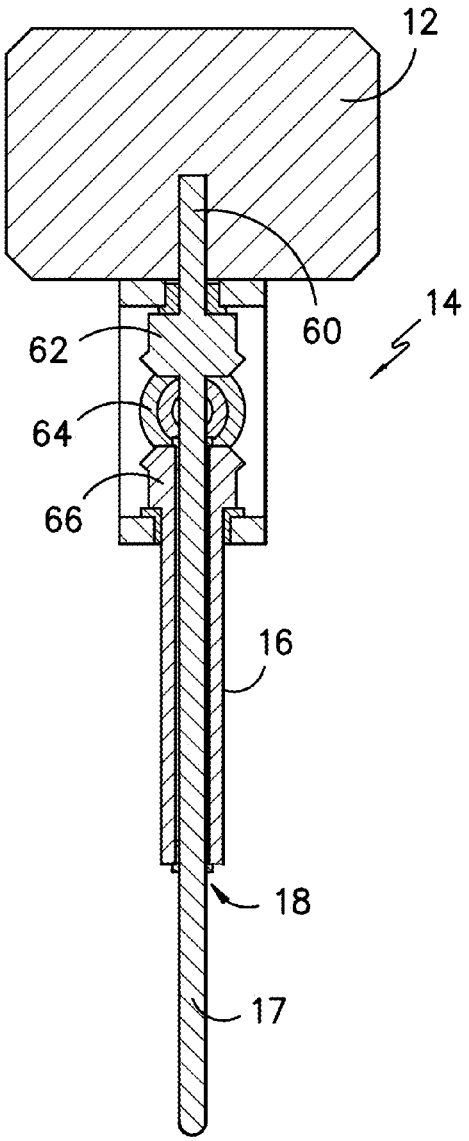
FIG. 6 shows an cut away of an exemplary gearbox of the exemplary mixer apparatus shown in FIG. 5.
Figure 7:
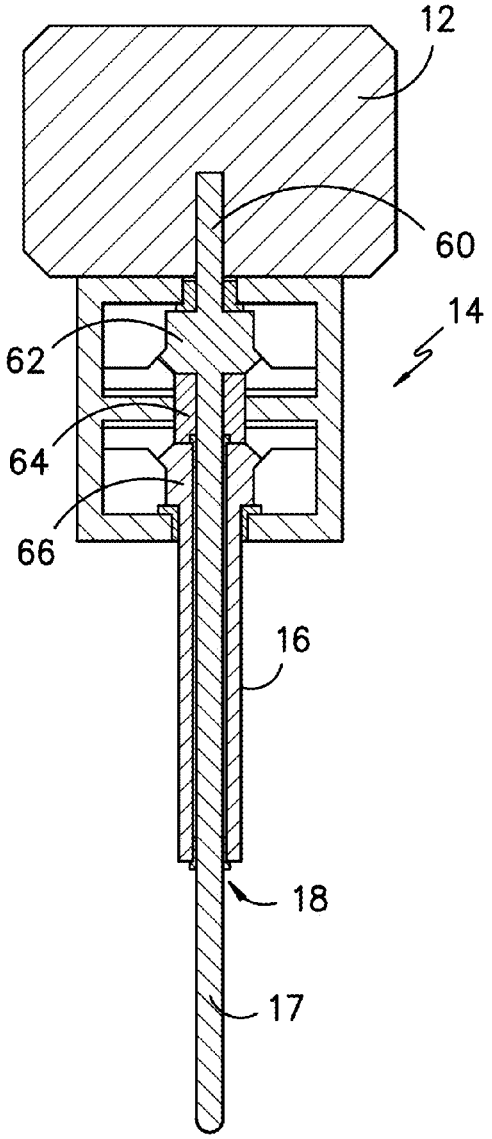
FIG. 7 shows a cut away of another exemplary gearbox of the exemplary mixer apparatus shown in FIG. 5.

Each of FIGS. 6 and 7 show an exemplary gearbox 14 that is configured to rotate the inner shaft 17 and the outer shaft 16 in opposite directions. In these embodiments, the motor 12 rotates the motor shaft 60 in one direction. The first gear 62 contacts and rotates the transmission gear 64. The transmission gear 64 in turn contacts and rotates the second gear 66 in an opposite direction of the first gear 62. The second gear 66 is connected to the outer shaft 16 (which defines a hollow center 18 through which the inner shaft 17 extends). Thus, the outer shaft 16 rotates in an opposite direction than the inner shaft 17.

As shown, the motor shaft 60 is connected to a first gear 62 and to the inner shaft 17. However, it is to be understood that the motor shaft 60 could be connected to the outer shaft 16 in other embodiments. Likewise, the second gear 66 could be connected to the inner shaft 17.

As known in the art, the first gear 62, the transmission gear 64, and/or the second gear 66 can have teeth or cogs, which mesh with a toothed/cogged of an adjacent gear in order to transmit torque.

No matter the particular configuration of the gearbox, each of the shafts 16, 17 are coupled to a rotor 20, 22, respectively. Due to the counter-rotation of the shafts 16, 17, the rotors 20, 22 are configured to rotate in opposite directions (i.e., contra-rotating). The rotors 20, 22 are shown vertically arranged, with the upper rotor 20 positioned closest to the gearboxes 14, 15 and above the lower rotor 22.

The rotors 20, 22 are connected to a plurality of rotor blades 21, 23, respectively. Although shown having four rotor blades 21, 23, any suitable number of rotor blades 21, 23 can be attached to the rotors 20, 22 (e.g., about two blades to about eight blades). The rotor blades 21, 23 can be curved and/or angled to help force the contents of the vessel in the direction desired. As show, the rotors 20, 22 with the rotor blades 21, 23 can be described as a propeller. In another embodiment, the rotors 20, 22 with the rotor blades 21, 23 can be an impeller with a casing (not shown) surrounding the outer edges of the rotor blades 21, 23.

The rotational speed of each rotor 20, 22 (and their rotor blades 21, 23) and the speed ratio between the two rotors 20, 22 can be controlled to create the desired mixing motion of the contents of the vessel. For example, in one embodiment, the rotors 20, 22 are rotating at the same speed, but in opposite directions. In this embodiment, if the rotors 20, 22 and blades 21, 23 are substantially the same size, the contra-rotating rotors 20, 22 can serve to substantially eliminate torque applied to the contents/vessel during use. In alternative embodiments, the rotors 20, 22 are rotating at differing speeds and in opposite directions.

In the embodiment of FIGS. 1 and 2, the angle of the blades and/or rotation direction of the upper rotor are such that the contents of the vessel are directed downward (toward the lower rotor), while the angle of the blades and/or rotation direction of the lower rotor are such that the contents are directed upward (toward the upper rotor). Thus, in this embodiment, the rotors are configured to direct the contents toward each other.

In an alternative shown in FIG. 3, the angle of the blades and/or rotation direction of the upper rotor are such that the contents of the vessel are directed upward (away from the lower rotor), while the angle of the blades and/or rotation direction of the lower rotor are such that the contents are directed downward (away from the upper rotor). Thus, in this embodiment, the rotors are configured to direct the contents away each other.

The direction of rotation can be reversed in both the embodiments shown in FIGS. 1 and 3, respectively. For example, FIG. 8A shows an exemplary embodiment having the opposite rotational direction of both the upper rotor 20 and the lower rotor 22, respectively, than that shown in FIG. 1, along with suitably angled rotor blades 21, 23. Such a reversed embodiment can be applied to each of the embodiments shown in FIGS. 8A-8H.

Additional variables are associated with the design of the rotor blades 21, 23 and can be adjusted to achieve the desired mixing motion of the contents of the vessel, such as their angle, their cross-sectional shape, their aspect ratio, etc. Likewise, the solidity (defined as the ratio of the total projected area of the blades 21, 23 divided by the area swept by the rotor 20, 22/blades 21, 23) of the rotors 20, 22 can be controlled as desired.

The spacing between the upper rotor 20 and the lower rotor 22 can also be adjusted as desired. In most embodiments, however, distance between the rotors 20, 22 (referred to as $D_R$ in FIGS. 1 and 3) can be less than the average length (referred to as $L_B$ in FIGS. 1 and 3) of the individual rotor blades 21 and/or 23 on the rotors 20, 22 respectively. For example, the distance $D_R$ can be about 10% to about 50% of the average length $L_B$ of the rotor blades 21 and/or 23. As such, the rotor blades 21, 23 affect a relatively wide diameter within the mixing vessel, while mixing within a relatively small space between the rotors 20, 22.

FIG. 4 shows an exemplary mixer apparatus 10, similar to that shown in FIG. 1, utilized to mix the contents 42 of a mixing vessel 40. The mixing vessel 40 has an inner surface 41 that is substantially smooth and/or free from baffles. Although shown in a liquid form, it is understood that the contents 42 can be a solid (e.g., a plurality of solid particles), a liquid, a gas, or a mixture thereof.

In the embodiment of FIG. 4, handles 30 are attached to the motor housing 13 of the motor 12 to allow a user to manually control the mixer apparatus 10 as desired. In other embodiments, the mixing apparatus 10 can be fixed in place (e.g., in a manufacturing setting). Also in this embodiment, an extension 32 is positioned below the lower rotor 22 such that the lower rotor 22 is protected from contacting the bottom surface of the vessel 40. Although not shown, a casing can be positioned around the ends of the rotor blades 21, 23 and attached to the mixing apparatus 12 to prevent the edges of the blades 21, 23 from contacting the inner surface 41 of the vessel 40.

The shaft length $L_S$ of the shafts 16, 17, measured from the gearboxes 14, 15 to the upper rotor 20, can be any suitable length depending on the size of the vessel 40 and the depth of the contents 42. Generally, however, the shaft length $L_S$ can be greater than the average length $L_B$ of the rotor blades 21 and/or 23 in most embodiments.

II. Parallel Toroidal Flow, Contra-Rotating Rotors

In another embodiment, apparatus and methods are generally provided for mixing the contents of a reaction/mixing vessel using similar (e.g., parallel) toroidal flow created by contra-rotating rotors. As discussed above, the mixing apparatus generally includes two coaxial shafts, one within another (e.g., an inner shaft and an outer shaft), rotating in opposite directions. Rotors with angled rotor blades are attached to each shaft in axial proximity to each other such that the axis of rotation of the two shafts is substantially aligned with the vertical axis of the reaction/mixing vessel (e.g., a cylindrical vessel).

Referring to FIG. 8C, an embodiment is shown having matching toroidal flow directed upward created by contra-rotating rotors 20, 22 and suitably angled blades 21, 23. On the other hand, FIG. 8D shows an embodiment with matching toroidal flow directed downward created by contra-rotating rotors 20, 22 and suitably angled blades 21, 23.

III. Opposing Toroidal Flow, Dual Rotors

In yet another embodiment, apparatus and methods are generally provided for mixing the contents of a reaction/mixing vessel using opposing toroidal flow created by dual rotors rotating in the same direction (e.g., matching-rotating rotors). FIG. 8E shows an embodiment with opposing toroidal flow directed inward created by dual-rotating rotors 20, 22 and suitably angled blades 21, 23. To the contrary, FIG. 8F shows an embodiment with opposing toroidal flow directed outward created by dual-rotating rotors 20, 22 and suitably angled blades 21, 23.

In such an embodiment, the mixing apparatus generally can includes two coaxial shafts (as shown in FIGS. 1-7), one within another, rotating in the same direction. As such, the rotors 20, 22 can be rotated at the same or different speeds. Alternatively, the rotors 20, 22 can be attached to a single shaft 16, since their rotation is in the same direction.

IV. Parallel Toroidal Flow, Dual Rotors

In yet another embodiment, apparatus and methods are generally provided for mixing the contents of a reaction/mixing vessel using matching (e.g., parallel) toroidal flow created by dual rotors rotating in the same direction (e.g., matching-rotating rotors). FIG. 8G shows an embodiment with matching toroidal flow directed upward created by dual-rotating rotors 20, 22 and suitably angled blades 21, 23. Conversely, FIG. 8H shows an embodiment with matching toroidal flow directed downward created by dual-rotating rotors 20, 22 and suitably angled blades 21, 23.

In such an embodiment, the mixing apparatus generally can includes two coaxial shafts (as shown in FIGS. 1-7), one within another, rotating in the same direction. As such, the rotors 20, 22 can be rotated at the same or different speeds. Alternatively, the rotors 20, 22 can be attached to a single shaft 16, since their rotation is in the same direction.

V. Manual Operation

FIGS. 9A and 9B show an alternative embodiment that includes a hand-powered mixer, instead of a motor-powered mixer, as the rotational mechanism. In this embodiment, the push-operated mechanism 90 powers the rotation of the shafts 16 and/or 17 on the down stroke and/or the return stroke (powered by the return spring) of the handle shaft 92 within the housing 94. For example, the user can push down on the handle 96, causing the handle shaft 92 to slide into the housing 94. As the handle shaft 92 enters the housing 94, the internal screw mechanism 98 is rotated.

The rotation of the internal screw mechanism 98 causes, in conjunction with the workings of the gearbox 14, rotation of shafts 16 and/or 17 as described above with respect to FIGS. 1-8 (i.e., substituting the motor 12 for the push-operated mechanism 90). As such, any combination of rotation of the upper rotor 20 and lower rotor 22 can be utilized (e.g., as shown in FIGS. 8A-8H).

COMPARATIVE EXAMPLES

For comparison, four different mixer apparatus were made with each mixer apparatus having a single impeller.

Comparative Example 1

Figure 10A:
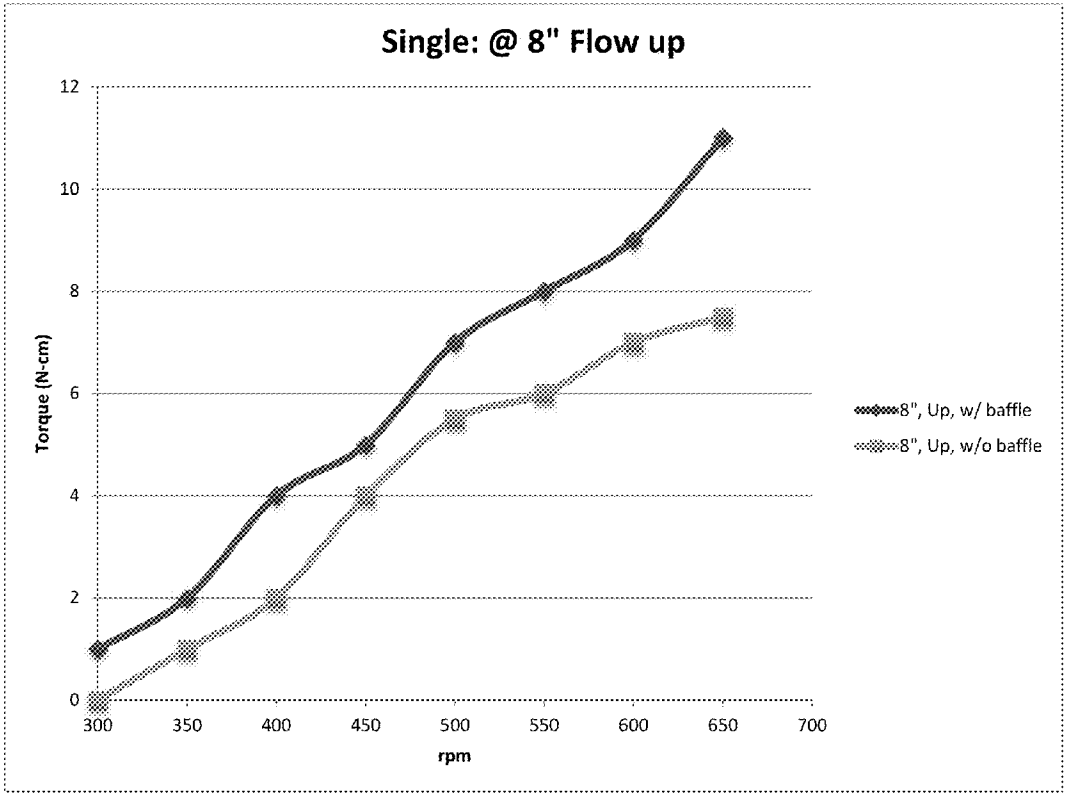
FIGS. 10A-10D show a plot of the torque mixing study of comparative mixer apparatus having a single shaft with a single impeller, with and without a baffle present, performed according to the comparative examples.

A mixer apparatus was made with a single impeller with rotor blades situated 8 inches from the tank bottom that, in use, are configured to force fluid flow up. FIG. 10A shows the amount of torque created at various rotations per minute (RPM) of the impeller, with baffles present and absent in the mixing vessel. A uniform suspension was not observed at any rpm or torque, with or without baffles present.

Comparative Example 2

Figure 10B:
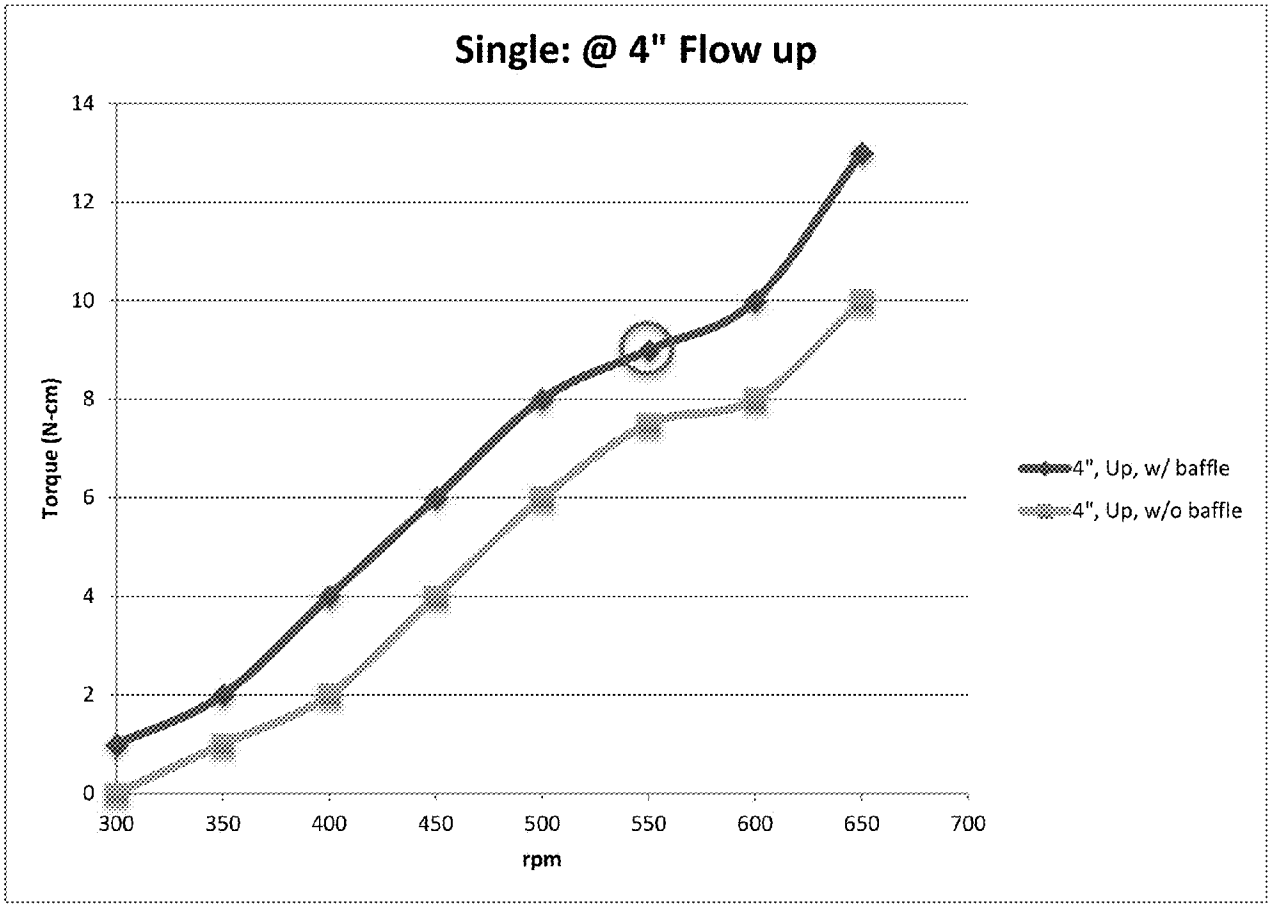

A mixer apparatus was made with a single impeller with rotor blades situated 4 inches from the tank bottom that, in use, are configured to force fluid flow up. FIG. 10B shows the amount of torque created at various rotations per minute (RPM) of the impeller, with baffles present and absent in the mixing vessel. The minimum rpm for a uniform suspension was observed with baffles at 550 rpm and a torque of 9 N-cm (circled in FIG. 10B).

Comparative Example 3

Figure 10C:
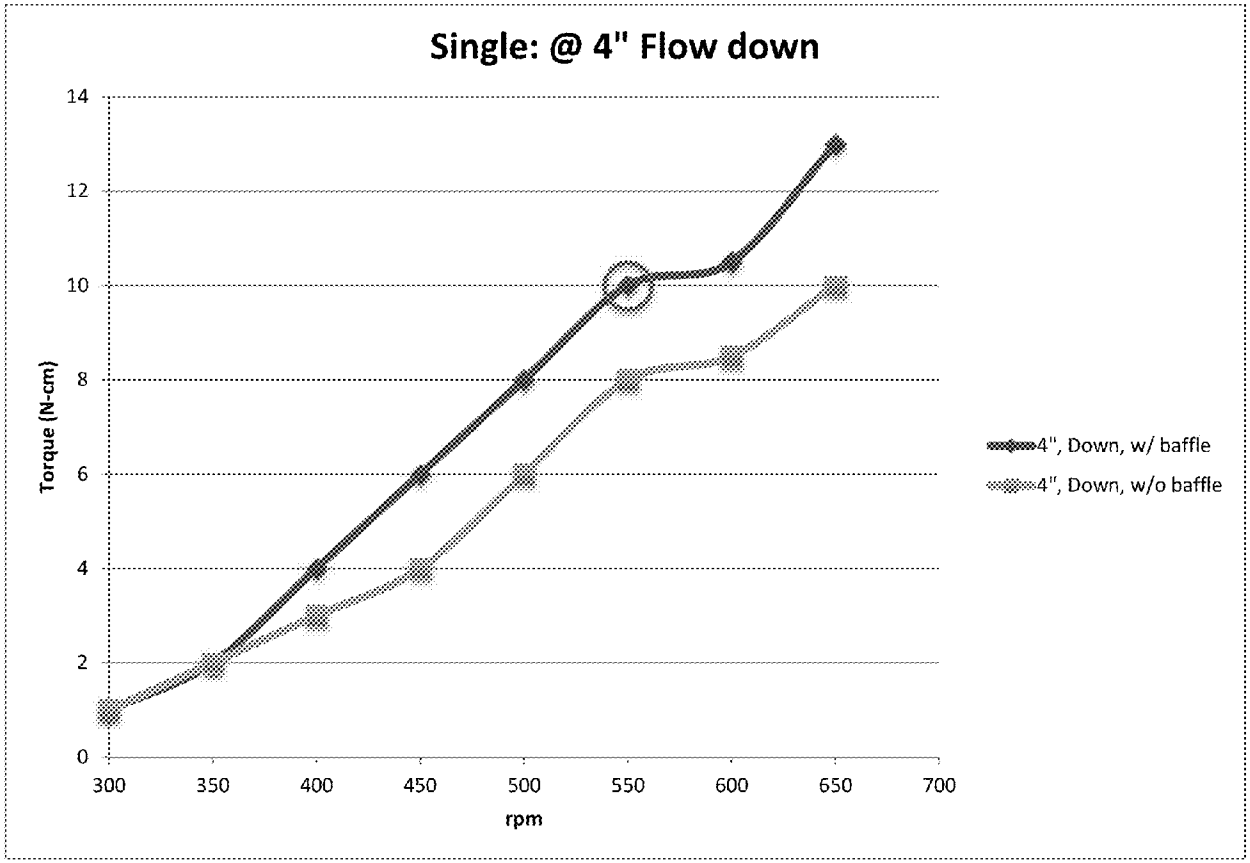

A mixer apparatus was made with a single impeller with rotor blades situated 4 inches from the tank bottom that, in use, are configured to force fluid flow down. FIG. 100 shows the amount of torque created at various rotations per minute (RPM) of the impeller, with baffles present and absent in the mixing vessel. The minimum rpm for a uniform suspension was observed with baffles at 550 rpm and a torque of 10 N-cm (circled in FIG. 10C).

Comparative Example 4

Figure 10D:
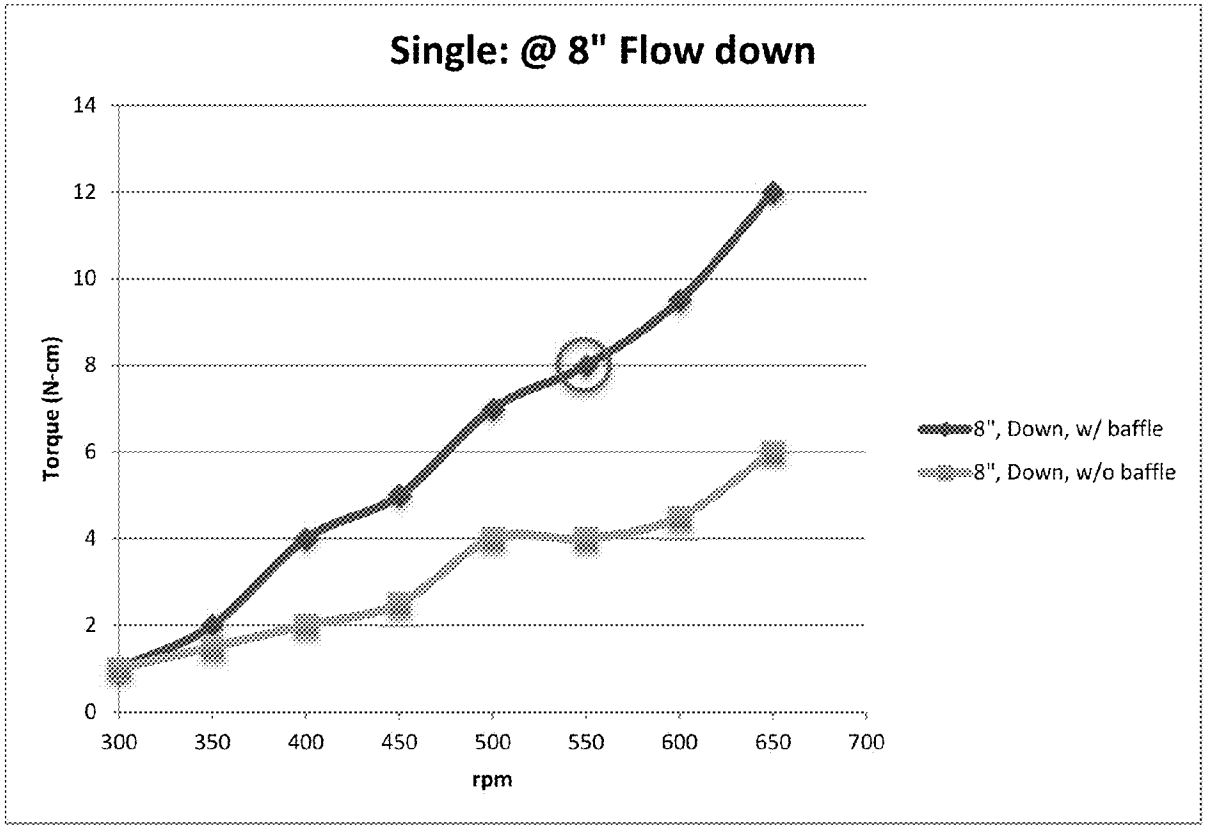

A mixer apparatus was made with a single impeller with rotor blades situated 8 inches from the tank bottom that, in use, are configured to force fluid flow down. FIG. 10D shows the amount of torque created at various rotations per minute (RPM) of the impeller, with baffles present and absent in the mixing vessel. The minimum rpm for a uniform suspension was observed with baffles at 550 rpm and a torque of 8 N-cm (circled in FIG. 10D).

EXAMPLES

Mixer apparatus were made having various two rotor configurations (i.e., dual impellers). FIGS. 11A-11D show a plot of the torque mixing study of exemplary mixer apparatus having a single shaft with dual impellers, with and without a baffle present, performed according to the examples. FIG. 12 shows a plot of the torque mixing study of exemplary mixer apparatus having contra-rotating shafts with dual impellers performed according to the examples.

Example 1

A mixer apparatus was made with dual impellers situated 4 and 8 inches from the tank bottom that are aligned with one over the other and configured to rotate in the same direction (e.g., a single shaft). In use, the top impeller was configured to force fluid flow down (toward the bottom impeller), and the bottom impeller was configured to force fluid flow up (toward the top impeller). FIG. 8E shows a general schematic of this dual impellers configuration.

Figure 11A:
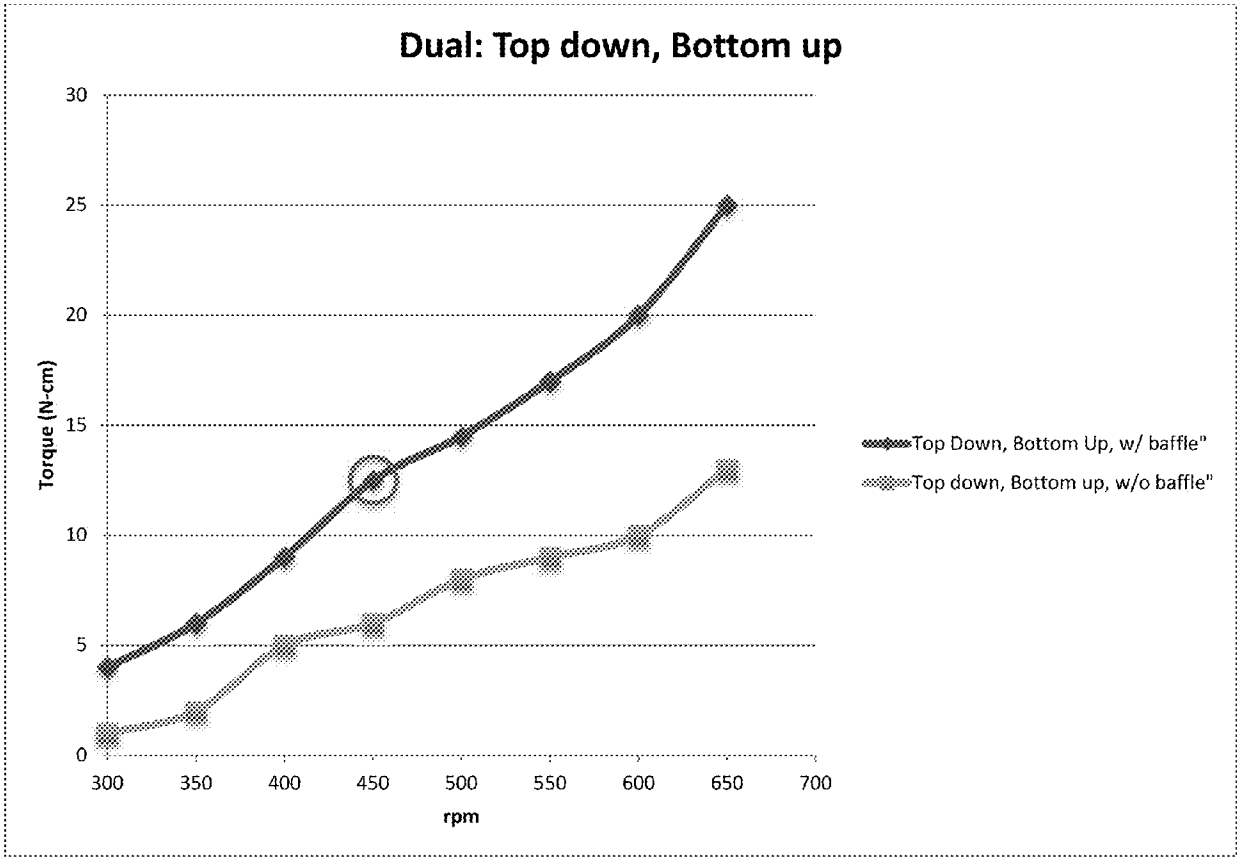
FIGS. 11A-11D show a plot of the torque mixing study of exemplary mixer apparatus having a single shaft with a dual impellers, with and without a baffle present, performed according to the examples.
Figure 12:
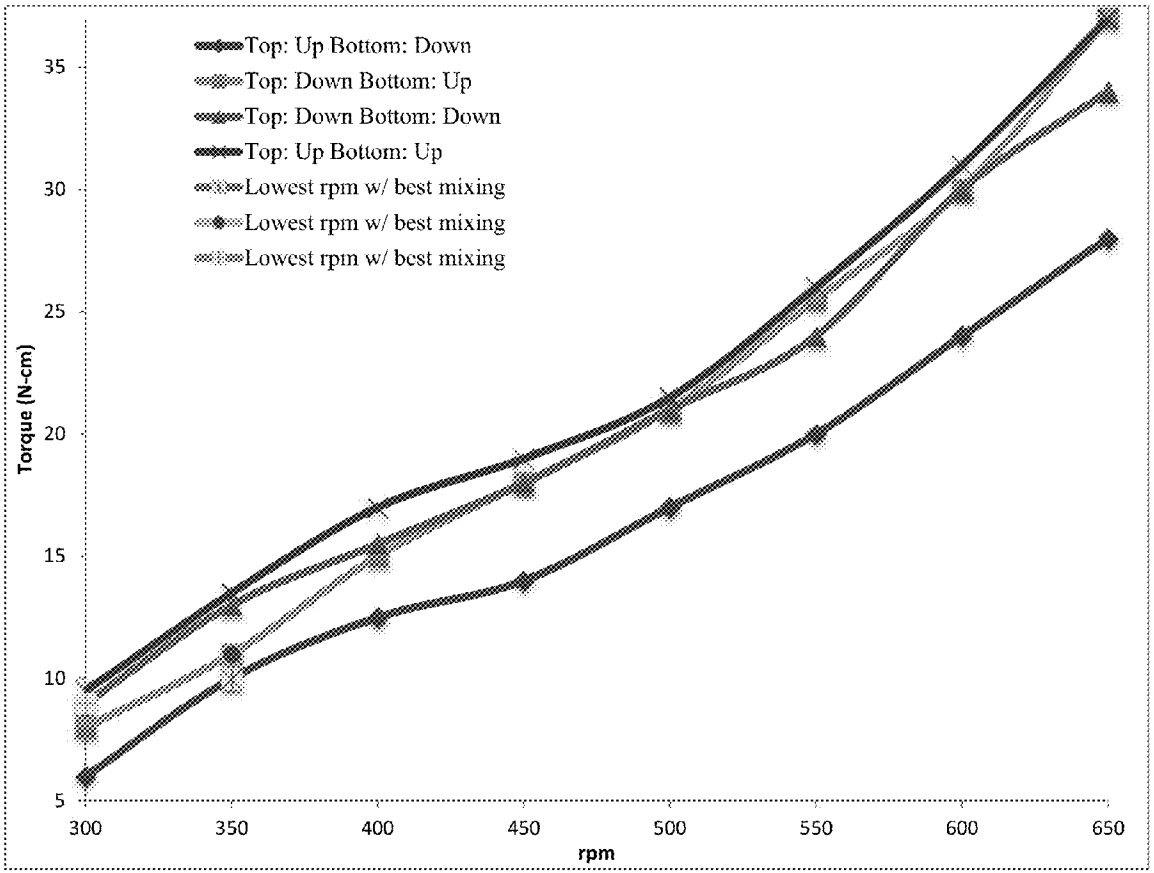
FIG. 12 shows a plot of the torque mixing study of exemplary mixer apparatus having a contra-rotating shafts with a dual impellers performed according to the examples.

FIG. 11A shows the amount of torque created at various rotations per minute (RPM) of the impeller, with baffles present and absent in the mixing vessel. The minimum rpm for a uniform suspension was observed with baffles at 450 rpm and a torque of 12.5 N-cm (circled in FIG. 11A).

Example 2

A mixer apparatus was made with dual impellers situated 4 and 8 inches from the tank bottom that are aligned with one over the other and configured to rotate in the same direction (e.g., a single shaft). In use, the top impeller was configured to force fluid flow down (toward the bottom impeller), and the bottom impeller was configured to force fluid flow down (away from the top impeller). FIG. 8H shows a general schematic of this dual impellers configuration.

Figure 11B:
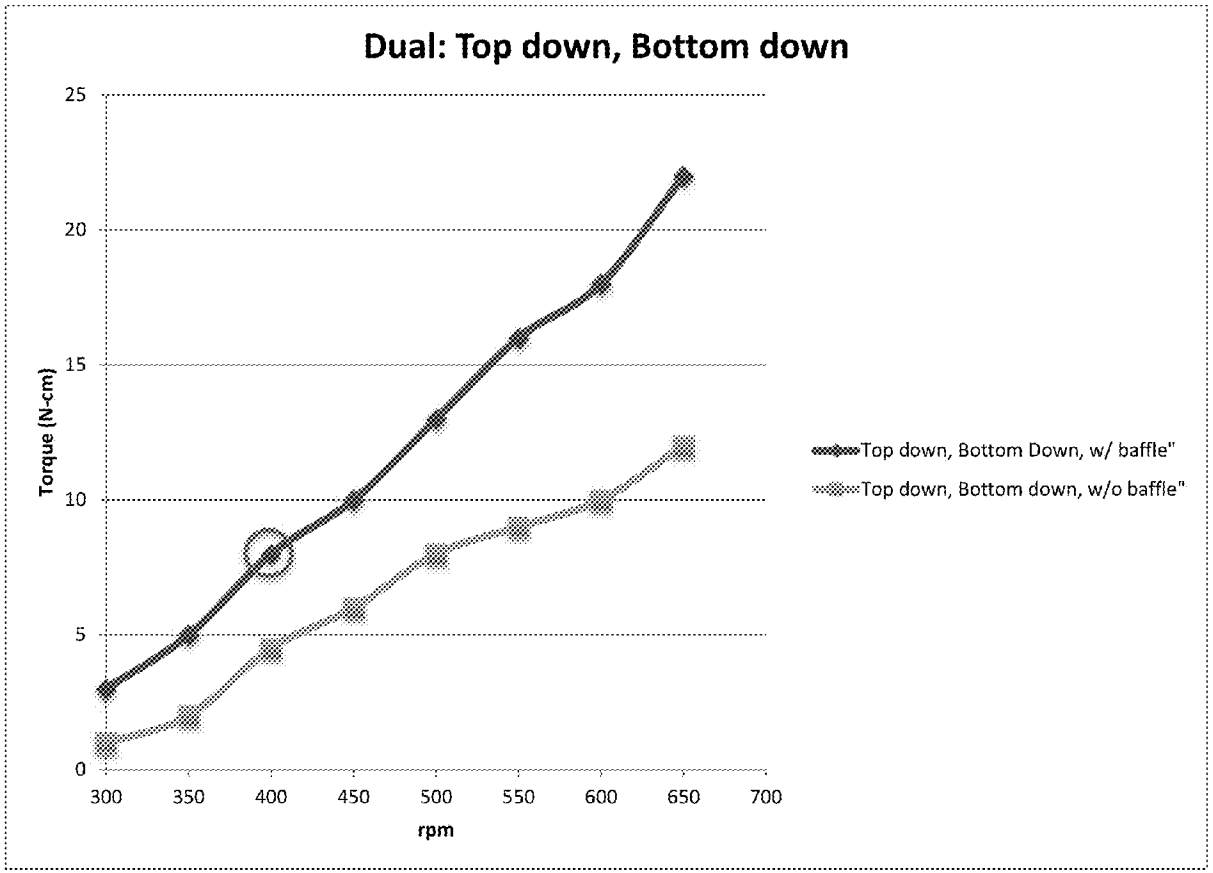

FIG. 11B shows the amount of torque created at various rotations per minute (RPM) of the impeller, with baffles present and absent in the mixing vessel. The minimum rpm for a uniform suspension was observed with baffles at 400 rpm and a torque of 8 N-cm (circled in FIG. 11B).

Example 3

A mixer apparatus was made with dual impellers situated 4 and 8 inches from the tank bottom that are aligned with one over the other and configured to rotate in the same direction (e.g., a single shaft). In use, the top impeller was configured to force fluid flow up (away from the bottom impeller), and the bottom impeller was configured to force fluid flow down (away the top impeller). FIG. 8F shows a general schematic of this dual impellers configuration.

Figure 11C:
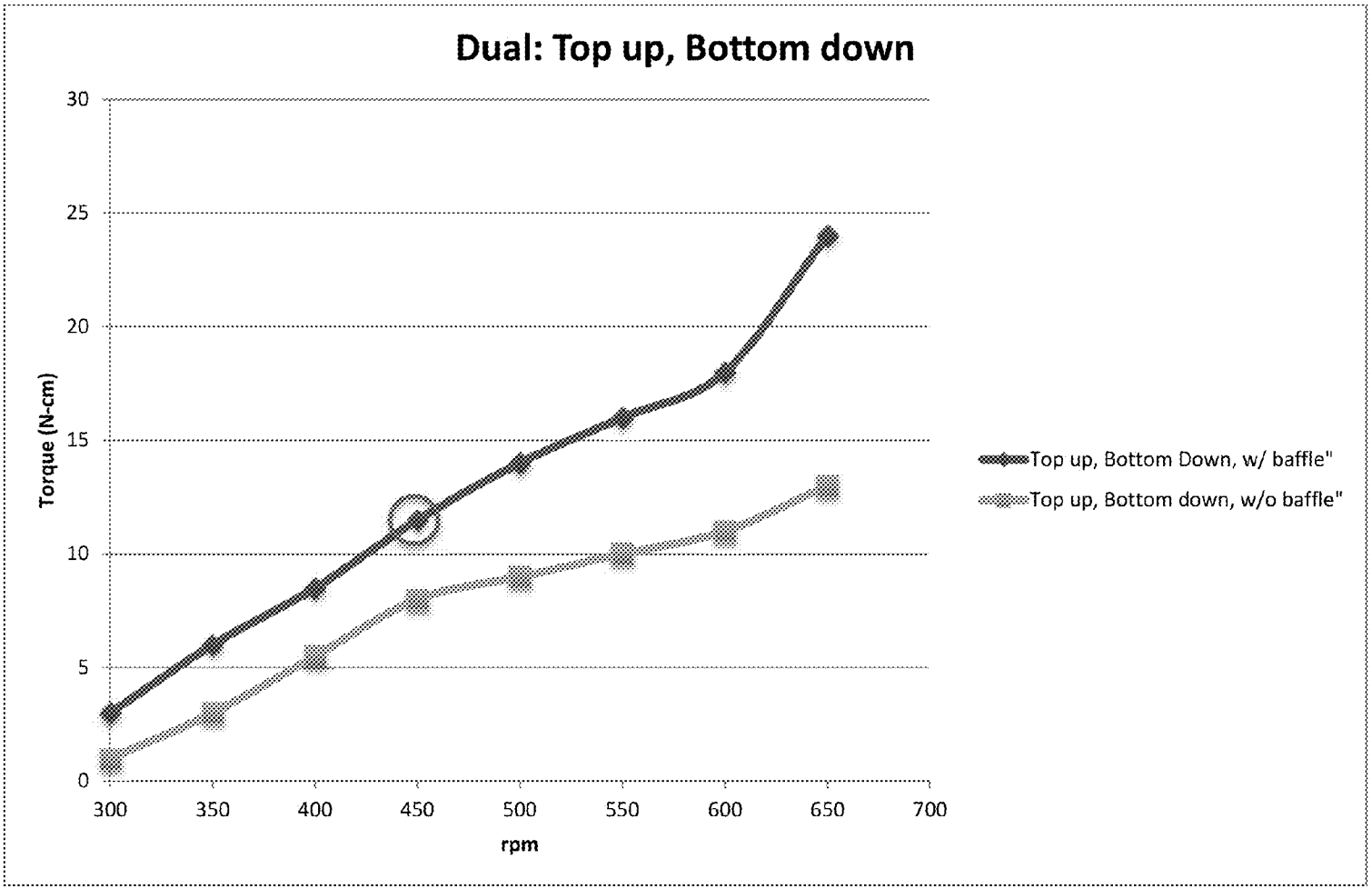

FIG. 11C shows the amount of torque created at various rotations per minute (RPM) of the impeller, with baffles present and absent in the mixing vessel. The minimum rpm for a uniform suspension was observed with baffles at 450 rpm and a torque of 12 N-cm (circled in FIG. 11C).

Example 4

A mixer apparatus was made with dual impellers situated 4 and 8 inches from the tank bottom that are aligned with one over the other and configured to rotate in the same direction (e.g., a single shaft). In use, the top impeller was configured to force fluid flow up (away from the bottom impeller), and the bottom impeller was configured to force fluid flow up (toward the top impeller). FIG. 8G shows a general schematic of this dual impellers configuration.

Figure 11D:
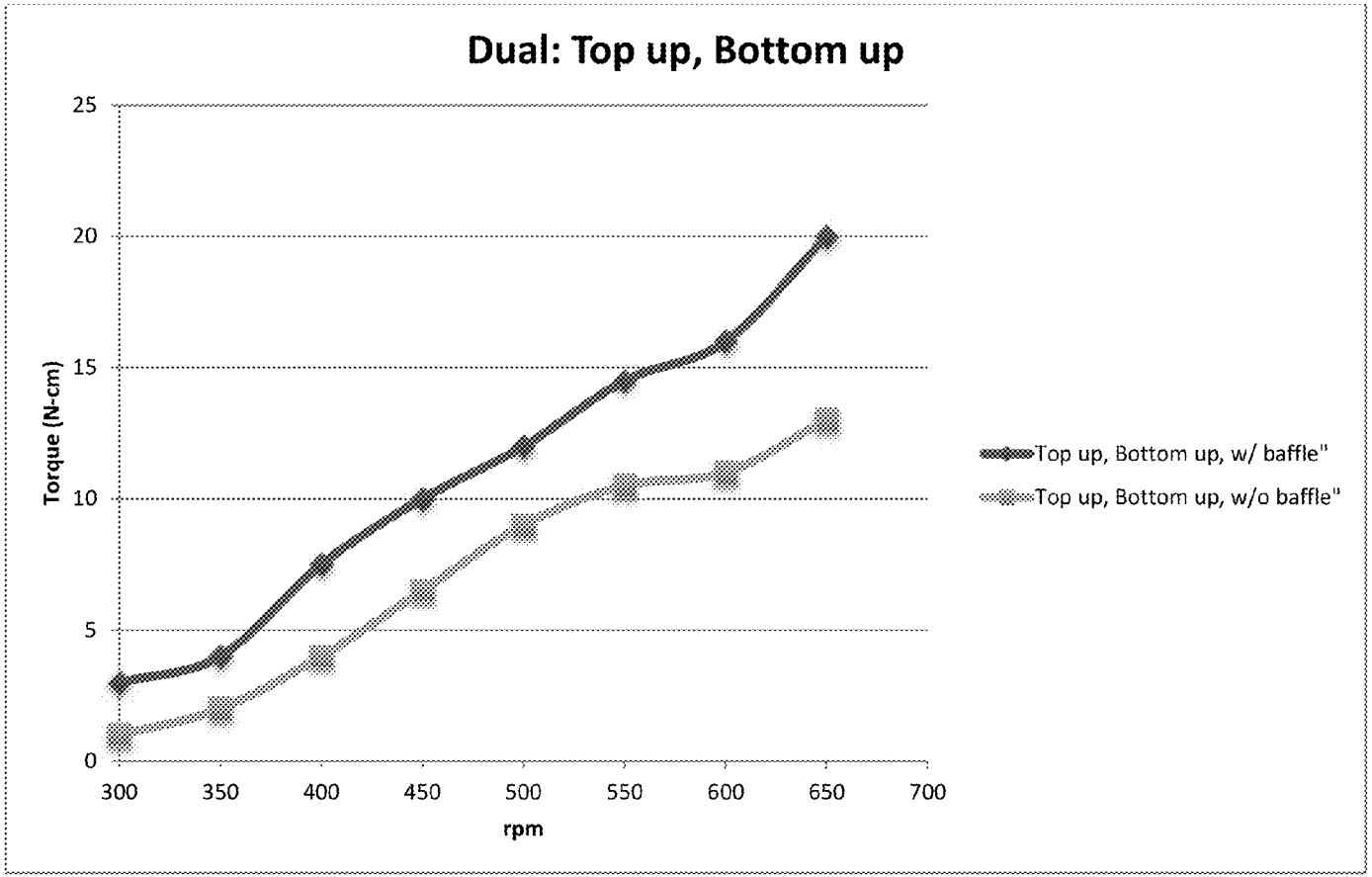

FIG. 11D shows the amount of torque created at various rotations per minute (RPM) of the impeller, with baffles present and absent in the mixing vessel. A uniform suspension was not observed at any rpm or torque, with or without baffles.

Example 5

A mixer apparatus was made with dual impellers situated 4 and 8 inches from the tank bottom that are aligned with one over the other and configured to rotate in opposite directions (e.g., a dual shaft). In use, the top impeller was configured to force fluid flow up (away from the bottom impeller), and the bottom impeller was configured to force fluid flow down (away from the top impeller). No baffles were used. FIG. 8B shows a general schematic of this dual impellers configuration.

FIG. 12 shows the amount of torque created at various rotations per minute (RPM) of the impeller, represented by the solid line with diamond data points. The minimum rpm for a uniform suspension was observed at 350 rpm and a torque of 10 N-cm (indicated in FIG. 12).

Example 6

A mixer apparatus was made with dual impellers situated 4 and 8 inches from the tank bottom that are aligned with one over the other and configured to rotate in opposite directions (e.g., a dual shaft). In use, the top impeller was configured to force fluid flow down (toward the bottom impeller), and the bottom impeller was configured to force fluid flow up (toward the top impeller). No baffles were used. FIG. 8A shows a general schematic of this dual impellers configuration.

FIG. 12 shows the amount of torque created at various rotations per minute (RPM) of the impeller, represented by the solid line with square data points. The minimum rpm for a uniform suspension was observed at 350 rpm and a torque of 11 N-cm (indicated in FIG. 12).

Example 7

A mixer apparatus was made with dual impellers situated 4 and 8 inches from the tank bottom that are aligned with one over the other and configured to rotate in opposite directions (e.g., a dual shaft). In use, the top impeller was configured to force fluid flow down (toward the bottom impeller), and the bottom impeller was configured to force fluid flow down (away the top impeller). No baffles were used. FIG. 8D shows a general schematic of this dual impellers configuration.

FIG. 12 shows the amount of torque created at various rotations per minute (RPM) of the impeller, represented by the solid line with triangle data points. The minimum rpm for a uniform suspension was observed at 300 rpm and a torque of 9 N-cm (indicated in FIG. 12).

Example 8

A mixer apparatus was made with dual impellers situated 4 and 8 inches from the tank bottom that are aligned with one over the other and configured to rotate in opposite directions (e.g., a dual shaft). In use, the top impeller was configured to force fluid flow up (away from the bottom impeller), and the bottom impeller was configured to force fluid flow up (toward the top impeller). No baffles were used. FIG. 8C shows a general schematic of this dual impellers configuration.

FIG. 12 shows the amount of torque created at various rotations per minute (RPM) of the impeller, represented by the solid line with "X" data points. A uniform suspension was not observed at any rpm or torque.

Summary of Examples

Figure 13:
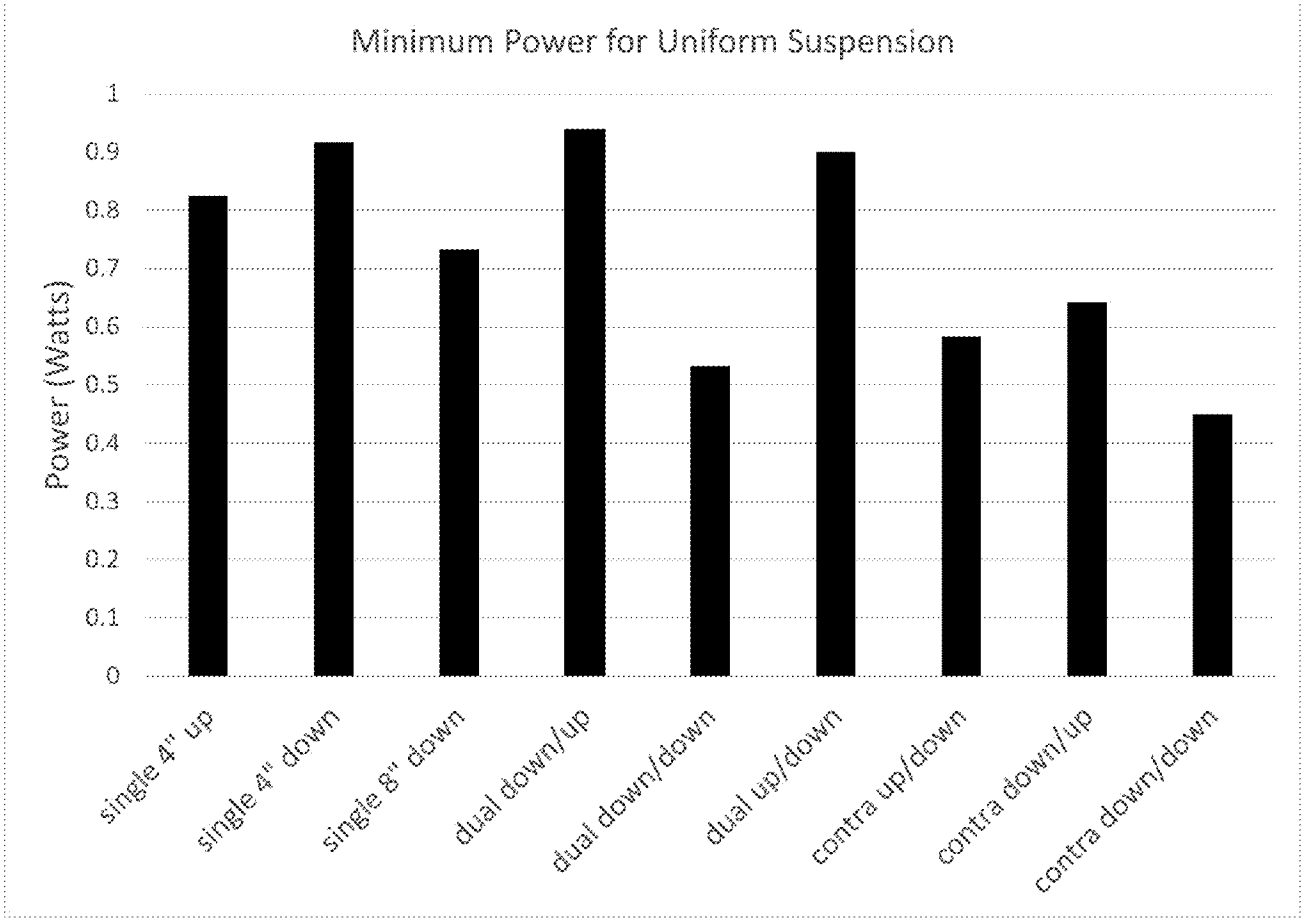
FIG. 13 shows the power (in Watts, W) needed for uniform mixing for the nine examples in which uniform suspensions were observed.

The product of RPM and torque is power. The power (in Watts, W) needed for uniform mixing for the nine cases in which uniform suspensions were observed is summarized in FIG. 13. In general, the power required by the contra-rotating impellers was less than that for the single or dual impellers on one shaft. The lowest value of required power, 0.45 W for the contra down/down configuration, was 15% lower than the minimum power (0.53 W) of the single shaft configurations (dual down/down).

These and other modifications and variations to the present invention may be practiced by those of ordinary skill in the art, without departing from the spirit and scope of the present invention, which is more particularly set forth in the appended claims. In addition, it should be understood the aspects of the various embodiments may be interchanged both in whole or in part. Furthermore, those of ordinary skill in the art will appreciate that the foregoing description is by way of example only, and is not intended to limit the invention so further described in the appended claims.

What is claimed:

1. A mixer apparatus configured to mix the contents of a vessel without the formation of a vortex, the mixer apparatus comprising:

a rotational mechanism;

a gearbox attached to the rotational mechanism;

a first shaft attached to the gearbox;

a second shaft attached to the gearbox, wherein the first shaft is coaxial with the second shaft, and wherein the gearbox is configured to rotate the first shaft and the second shaft in opposite directions;

a first rotor configured to be rotated by the first shaft, wherein the first rotor comprises a plurality of first rotor blades; and a second rotor configured to be rotated by the second shaft, wherein the second rotor comprises a plurality of second rotor blades, and wherein the first rotor and the plurality of first rotor blades and the second rotor and the plurality of second rotor blades form an opposing toroidal flow without the formation of a vortex in the vessel, wherein a distance between the first rotor and the second rotor is less than an average length of the plurality of first rotor blades and the plurality of second rotor blades, the distance between the first rotor and the second rotor adjustable from ten percent to fifty percent of the average length of the plurality of first rotor blades and the plurality of second rotor blades.

2. The mixer apparatus as in claim 1, wherein the rotational mechanism is a motor.

3. The mixer apparatus as in claim 1, wherein the rotational mechanism is a push-operated mechanism.

4. The mixer apparatus as in claim 3, wherein the push-operated mechanism comprises a handle shaft within a housing such that insertion of the handle shaft into the housing causes an internal screw mechanism to rotate, and wherein the internal screw mechanism is attached to the gearbox, the push-operated mechanism further comprising a return spring coupled to the handle shaft.

5. The mixer apparatus as in claim 1, wherein the first rotor is configured to direct the contents of the vessel toward the second rotor, and wherein the second rotor is configured to direct the contents of the vessel toward the first rotor.

6. The mixer apparatus as in claim 1, wherein the first rotor is configured to direct the contents of the vessel away from the second rotor, and wherein the second rotor is configured to direct the contents of the vessel away from the first rotor.

7. The mixer apparatus as in claim 1, wherein the vessel defines a smooth inner surface.

8. The mixer apparatus as in claim 1, wherein the vessel is free from a baffle.

9. The mixer apparatus as in claim 1, wherein the mixer apparatus is free from a scraper.

10. The mixer apparatus as in claim 1, wherein the first rotor blades are angled in a first direction.

11. The mixer apparatus as in claim 1, wherein the second rotor blades are angled in a second direction.

12. The mixer apparatus as in claim 1, further comprising an extension mounted to the first shaft or the second shaft, the extension positioned below the first and second rotors such that the extension blocks the first and second rotors from contacting a bottom surface of the vessel, wherein the first shaft defines a hollow center, and wherein the second shaft is located within the hollow center defined by the first shaft and is independently rotatable therein.

13. The mixer apparatus as in claim 1, wherein the first rotor and the second rotor counter-rotate in a manner that substantially eliminates torque applied to the contents.

14. The mixer apparatus as in claim 1, wherein the first rotor is rotated at substantially the same speed, but in an opposite direction, as the second rotor.

15. A mixer apparatus configured to mix the contents of a vessel without the formation of a vortex, the mixer apparatus comprising:

a rotational mechanism;

a first gearbox attached to the rotational mechanism;

a second gearbox attached to the rotational mechanism;

a first shaft attached to the first gearbox;

a second shaft attached to the second gearbox, wherein the first shaft is coaxial with the second shaft;

a first rotor configured to be rotated by the first shaft, wherein the first rotor comprises a plurality of first rotor blades; and a second rotor configured to be rotated by the second shaft, wherein the second rotor comprises a plurality of second rotor blades, and wherein the first rotor and the plurality of first rotor blades and the second rotor and the plurality of second rotor blades form an opposing toroidal flow without the formation of a vortex in the vessel, wherein a distance between the first rotor and the second rotor is less than an average length of the plurality of first rotor blades and the plurality of second rotor blades, the distance between the first rotor and the second rotor adjustable from ten percent to fifty percent of the average length of the plurality of first rotor blades and the plurality of second rotor blades.

16. The mixer apparatus as in claim 15, wherein the vessel defines a smooth inner surface, and wherein the vessel is free from a baffle.

17. The mixer apparatus as in claim 15, wherein the mixer apparatus is free from a scraper.

18. The mixer apparatus as in claim 1, wherein the first rotor and the second rotor are configured to be rotated in opposite directions.

19. The mixer apparatus as in claim 1, wherein the first rotor and the second rotor are configured to be rotated in the same direction.

20. The mixer apparatus as in claim 15, wherein the first rotor and the second rotor are configured to be rotated in opposite directions.

21. The mixer apparatus as in claim 15, wherein the first rotor and the second rotor are configured to be rotated in the same direction.

22. The mixer apparatus as in claim 15, wherein the first rotor is configured to direct the contents of the vessel toward the second rotor, and wherein the second rotor is configured to direct the contents of the vessel toward the first rotor.

23. The mixer apparatus as in claim 15, wherein the first rotor is configured to direct the contents of the vessel away from the second rotor, and wherein the second rotor is configured to direct the contents of the vessel away from the first rotor.

* * * * *